US009884505B2

(12) United States Patent
Yumoto et al.

(10) Patent No.: US 9,884,505 B2
(45) Date of Patent: Feb. 6, 2018

(54) RECORDING MEDIUM AND PROCESS FOR PRODUCING SAME

(71) Applicant: CANON KABUSHIKI KAISHA, Tokyo (JP)

(72) Inventors: Shinya Yumoto, Kawasaki (JP); Hisao Kamo, Ushiku (JP); Tetsuro Noguchi, Hachioji (JP); Isamu Oguri, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 13 days.

(21) Appl. No.: 14/741,687

(22) Filed: Jun. 17, 2015

(65) Prior Publication Data

US 2015/0375553 A1 Dec. 31, 2015

(30) Foreign Application Priority Data

Jun. 27, 2014 (JP) ..... 2014-132352

(51) Int. Cl.

| | |
|---|---|
| ***B41M 5/50*** | (2006.01) |
| ***B41M 5/52*** | (2006.01) |
| ***B05D 1/00*** | (2006.01) |

(52) U.S. Cl.

CPC ..... *B41M 5/5254* (2013.01); *B05D 1/00* (2013.01); *B41M 5/50* (2013.01); *B41M 5/52* (2013.01); *B41M 5/5218* (2013.01); *B41M 5/5227* (2013.01); *B41M 5/5263* (2013.01)

(58) Field of Classification Search

CPC ..... B41M 5/50; B41M 5/5245; B05D 1/00
See application file for complete search history.

(56) References Cited

U.S. PATENT DOCUMENTS

| | | | |
|---|---|---|---|
| 4,474,847 | A | 10/1984 | Schröder et al. |
| 7,625,614 | B2 | 12/2009 | Kamo et al. |
| 7,846,516 | B2 | 12/2010 | Kamo et al. |
| 7,867,586 | B2 | 1/2011 | Kamo et al. |
| 8,153,212 | B2 | 4/2012 | Hyakuda et al. |
| 8,158,223 | B2 | 4/2012 | Hyakuda et al. |
| 8,252,392 | B2 | 8/2012 | Oguri et al. |
| 8,486,499 | B2 | 7/2013 | Nito et al. |
| 8,524,336 | B2 | 9/2013 | Oguri et al. |
| 8,609,209 | B2 | 12/2013 | Taguri et al. |
| 8,795,798 | B2 | 8/2014 | Oguri et al. |
| 8,846,166 | B2 | 9/2014 | Herlambang et al. |
| 2003/0049481 | A1* | 3/2003 | Tatsuhashi ..... B41M 5/52 428/533 |
| 2010/0043152 | A1 | 2/2010 | Terao et al. |
| 2015/0174936 | A1 | 6/2015 | Noguchi et al. |
| 2015/0174937 | A1 | 6/2015 | Oguri et al. |

FOREIGN PATENT DOCUMENTS

| | | | |
|---|---|---|---|
| CN | 101688358 | A | 3/2010 |
| EP | 1 101 626 | A2 | 5/2001 |
| EP | 1101626 | A3 | 8/2001 |
| JP | 2000-239578 | A | 9/2000 |
| JP | 3805246 | B2 | 8/2006 |

OTHER PUBLICATIONS

Oct. 30, 2015 European Search Report in European Patent Appln. No. 15001890.1.
Apr. 10, 2017 European Official Action in European Patent Appln. No. 15001890.1.
Jul. 3, 2017 Chinese Official Action in Chinese Patent Appln. No. 201510363370.6.

* cited by examiner

*Primary Examiner* — Betelhem Shewareged
(74) *Attorney, Agent, or Firm* — Fitzpatrick, Cella, Harper & Scinto

(57) ABSTRACT

A recording medium having a base and an ink receiving layer containing an inorganic particle and at least one compound selected from a compound represented by the following formula (I) and a compound represented by the following formula (II):

(I)

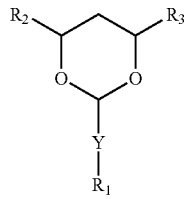

(II)

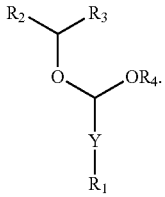

7 Claims, No Drawings

RECORDING MEDIUM AND PROCESS FOR PRODUCING SAME

BACKGROUND OF THE INVENTION

Field of the Invention

The present invention relates to a recording medium and a process for producing the same.

Description of the Related Art

In recent years, in an ink jet recording method, an increase in image recording speed is advancing. Even in the high speed recording, output of images with a high quality and miniaturization of a recording apparatus have been required.

First, in order to output images with high quality even in high speed recording, improvement in conveyance accuracy when conveying a recording medium is effective. Examples of a method of improving the conveyance accuracy include a method of using, as a conveying roller to be used for conveying a recording medium, a hardened roller. By using a hardened conveying roller, deterioration in conveyance accuracy due to deformation of the conveying roller at the time of conveyance can be suppressed. Contact with such a conveying roller however causes scratches or press traces (roller marks) on the side of the recording medium and provides an image with a deteriorated quality. The recording medium is therefore required to have high scratch resistance.

Next, for miniaturization of a recording device even in high speed recording, a method of conveying a recording medium while giving a large curvature thereto and thereby decreasing a conveying distance of the recording medium is cited. In this case, the curvature given to the recording medium sometimes causes cracks in the recording medium. The recording medium is therefore required to have high bending resistance.

Examples of a method of improving scratch resistance or bending resistance include a method of crosslinking an ink receiving layer (Japanese Patent Laid-Open No. 2000-239578 and Japanese Patent No. 3805246). Japanese Patent Laid-Open No. 2000-239578 discloses a recording medium having a porous layer composed mainly of an inorganic pigment and containing polyvinyl alcohol and boric acid. This porous layer has a structure in which the hydroxyl groups of the polyvinyl alcohol have been crosslinked through hydrogen bonding via boron. Japanese Patent No. 3805246 discloses a recording medium having a coloring-material-receiving layer composed mainly of an inorganic pigment and containing polyvinyl alcohol and a polyvalent metal salt. This coloring-material-receiving layer has a structure in which the hydroxyl groups of the polyvinyl alcohol have been crosslinked through covalent bonding via a metal atom.

SUMMARY OF THE INVENTION

In the recent ink jet recording methods, a recording apparatus is miniaturized by conveying a recording medium such as rolled recording medium while giving a large curvature thereto and thereby shortening the conveying distance of the recording medium.

As a result of study by the present inventors, however, when recording is performed at a high transfer rate with ink containing the resin fine particles described in Japanese Patent Laid-Open No. 2000-239578, an image with a high quality level desired in the present invention cannot be obtained. In addition, the ejection stability of the ink is low.

An object of the present invention is to provide an image recording method having high ink ejection stability and high transfer efficiency so as to provide a high-quality image even if recording is performed at a high transfer rate.

The study by the present inventors has however revealed that the respective recording media described in Japanese Patent Laid-Open No. 2000-239578 and Japanese Patent No. 3805246 are below the scratch resistance level and bending resistance level desired in the present invention. More specifically, the recording medium described in Japanese Patent Laid-Open No. 2000-239578 has a crosslinked structure formed by weak and reversible hydrogen bonding so that exposure to high humidity environment prevents it from exhibiting sufficient scratch resistance and bending resistance. In the recording medium described in Japanese Patent No. 3805246, on the other hand, the coloring-material-receiving layer is crosslinked firmly by covalent bonding so that the recoding medium has deteriorated flexibility and insufficient bending resistance.

An object of the present invention is therefore to provide a recording medium capable of outputting an image with high quality even in high speed recording and at the same time, having high scratch resistance and bending resistance so as to enable miniaturization of a recording apparatus.

The above-mentioned objects can be achieved by the present invention described below. In the present invention, there is therefore provided a recording medium having a base and an ink receiving layer containing an inorganic particle and at least one compound selected from a compound represented by the following formula (I) and a compound represented by the following formula (II), (I)

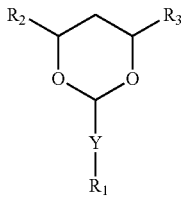

(II)

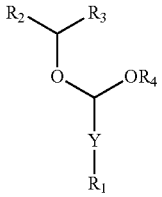

(in the formulas (I) and (II), $R_1$ represents a structure represented by the following formula (III) or a structure represented by the following formula (IV), and $R_2$ to $R_4$ each independently represent a hydrogen atom or a structure represented by $(CH_2)_n$— (n represents an integer of 1 or more), and Y represents a structure represented by the following formula (V)

(III)

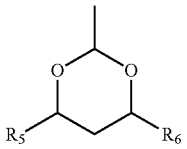

-continued (IV)

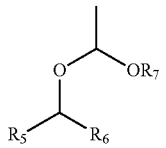

(in the formulas (III) and (IV), $R_5$ to $R_7$ each independently represent a hydrogen atom or a structure represented by $(CH_2)_n$— (n represents an integer of 1 or more)), (V)

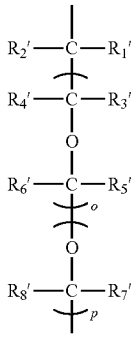

(in the formula (V), o and p each independently represent an integer of 0 or more but o and p do not simultaneously represent 0, $R'_1$ to $R'_8$ each independently represent a hydrogen atom, an alkyl group, a hydroxyalkyl group, a carbonyl group, —O—, a glucose group, or a structure represented by —$(CH_2)_n$— (n represents an integer of 1 or more))).

According to the present invention, a recording medium having high scratch resistance and bending resistance can be provided.

Further features of the present invention will become apparent from the following description of exemplary embodiments.

DESCRIPTION OF THE EMBODIMENTS

The present invention will hereinafter be described specifically by preferred embodiments, but the present invention is not limited to or by the following embodiments. The recording medium of the present invention has a base and an ink receiving layer containing an inorganic particle and at least one compound selected from a compound represented by the following formula (I) (which may hereinafter be called "compound of the formula (I)") and a compound represented by the following formula (II) (which may hereinafter be called "compound of the formula (II)").

The compounds of the formulas (I) and (II) contained in the ink receiving layer have, in the structure thereof, a Y site represented by the formula (V). Due to this structure, the ink receiving layer can have increased mechanical strength while maintaining its flexibility so that the recording medium is presumed to have enhanced scratch resistance and bending strength.

In the present invention, it is preferred to carry out, as a method of introducing the Y site into the ink receiving layer, crosslinking of a hydroxyl-containing polymer such as polyvinyl alcohol by using a polyvalent aldehyde such as dialdehyde starch having, in the molecule thereof, at least one of ether and acetal. This is presumed to make it possible to provide an ink receiving layer having both mechanical strength enhanced by crosslinking and flexibility while adjusting a crosslink distance between structures to be crosslinked and having high reactivity with a hydrophilic polymer. According to the study by the present inventors, on the other hand, an ink receiving layer cannot have sufficient flexibility even if a conventionally used crosslinking agent such as glyoxal or glutaraldehyde is selected from polyvalent aldehydes and used. The reason is that a crosslink distance is insufficient or the reaction efficiency with the hydrophilic polymer having a structure to be crosslinked decreases due to hydrophobicity of an alkylene group that adjusts the distance between structures to be crosslinked.

Each portion of the recording medium and materials constituting each portion will next be described in detail.

1. Base

As the base of the recording medium, conventionally known bases can be used. The following are examples of the base. Examples of an ink non-absorptive base include bases made of a resin film and bases having both surfaces coated with a resin. Examples of an ink absorptive base include fibrous bases. Examples of the base made of a resin film include polyester, polyvinyl chloride, polypropylene, and polystyrene, and bases obtained by laminating them. As these bases, transparent, translucent or opaque ones can be used. The base coated with a resin is preferably a base obtained by coating both surfaces of paper with a polyolefin resin. Examples of the polyolefin to be used for coating include polyethylene and polypropylene. Examples of the fibrous base include bases composed mainly of pulp, that is, those made of paper. The bases made of paper include base paper subjected to sizing press with a starch, polyvinyl alcohol, or the like, and coated paper, such as art paper, coated paper, and cast coated paper, having a coating layer provided on base paper.

2. Ink Receiving Layer

The ink receiving layer contains an inorganic particle and at least one compound selected from the compound of the formula (I) and the compound of the formula (II). The ink receiving layer can contain, in addition to them, a binder, a cationizing agent, boric acid, a borate, and the like if necessary. Materials that can be contained in the ink receiving layer will hereinafter be described in detail.

Compound Represented by the Formulas (I) and Compound Represented by the Formula (II)

The ink receiving layer of the recording medium of the present embodiment contains a compound having a structure represented by the following formula (I) and/or a compound having a structure represented by the following formula (II).

In the formulas (I) and (II), $R_2$ to $R_4$ each independently represent a hydrogen atom or a structure represented by $(CH_2)_n$— (n represents an integer of 1 or more). The hydrogen atom in the structure represented by $(CH_2)_n$— may be substituted by a substituent selected from an alkyl group, a hydroxyl group, an acetoester group, an acetoacetyl group, a carboxyl group, a carbonyl group, an ester group, an amide group, a silanol group, a polyalkylether group, an amino group, a sulfo group, a phosphoric acid ester group, a hydroxypropyl group, and an acetal group.

In the formulas (I) and (II), Y is a structure represented by the formula (V).

(I)

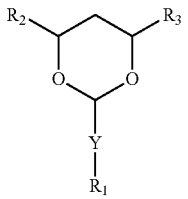

(II)

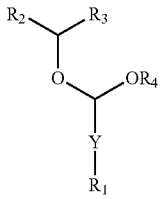

In the formulas (I) and (II), $R_1$ represents a structure represented by the formula (III) or a structure represented by the formula (IV).

(III)

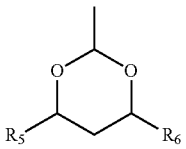

(IV)

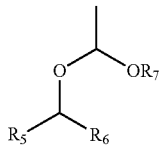

In the formulas (III) and (IV), $R_5$ to $R_7$ each independently represent a hydrogen atom or a structure represented by $(CH_2)_n$— (n represents an integer of 1 or more). The hydrogen atom in the structure represented by $(CH_2)_n$— may be substituted by a substituent selected from an alkyl group, a hydroxyl group, an acetoester group, an acetoacetyl group, a carboxyl group, a carbonyl group, an ester group, an amide group, a silanol group, a polyalkylether group, an amino group, a sulfo group, a phosphoric acid ester group, a hydroxypropyl group, and an acetal group. In the above formulas, n represents preferably 1 or more and not more than 6, more preferably 1 or more and not more than 3.

In the formulas (I) and (II), $R_2$ to $R_4$ each independently represent a hydrogen atom or a structure represented by $(CH_2)_n$— (n represents an integer of 1 or more). The hydrogen atom in the structure represented by $(CH_2)_n$— may be substituted by a substituent selected from an alkyl group, a hydroxyl group, an acetoester group, an acetoacetyl group, a carboxyl group, a carbonyl group, an ester group, an amide group, a silanol group, a polyalkylether group, an amino group, a sulfo group, a phosphoric acid ester group, a hydroxypropyl group, and an acetal group. In the above formulas, n represents preferably 1 or more and not more than 6, more preferably 1 or more and not more than 3.

Further, in the formulas (I) and (II), Y is a structure represented by the formula (V).

(V)

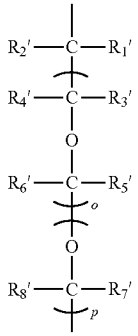

In the formula (V), o and p each independently represent an integer of 0 or more and o and p do not simultaneously represent 0. $R'_1$ to $R'_8$ each independently represent a hydrogen atom, an alkyl group, a hydroxyalkyl group, a carbonyl group, —O—, a glucose group, or a structure represented by $(CH_2)_n$— (n represents an integer of 1 or more). When any two of $R'_3$ to $R'_8$ represent $(CH_2)_n$—, they may form a cyclic structure and the cyclic structure may contain an oxygen atom. When any of $R'_1$ to $R'_8$ represents an alkyl group or a hydroxyalkyl group, the number of carbon atoms is preferably 1 or more and not more than 6, more preferably 0 or more and not more than 3. The structure represented by $(CH_2)_n$— may be substituted by a substituent and examples of the substituent include a hydroxyl group. In this structure, n is preferably 1 or more and not more than 6, more preferably 1 or more and not more than 3. Further, o and p satisfy preferably the following relation: $o \geq 0$, $p \geq 0$, $o = p \neq 0$, and $|o-p| = 1$, more preferably the following relation: $20 \geq o \geq 0$ and $20 \geq p \geq 0$.

The respective compounds of the formulas (I) and (II) are preferably compounds containing at least one repeating unit selected from the group consisting of the following formulas (VI) to (XI):

(VI)

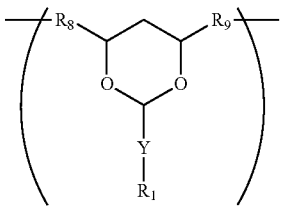

(VII)

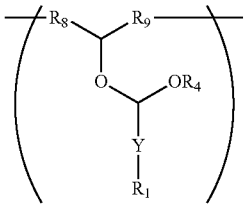

-continued (VIII)

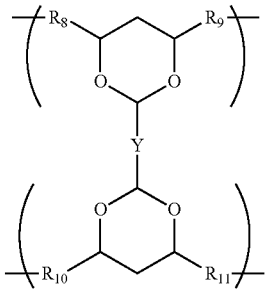

(IX)

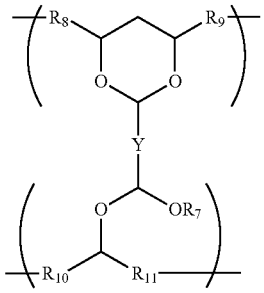

(X)

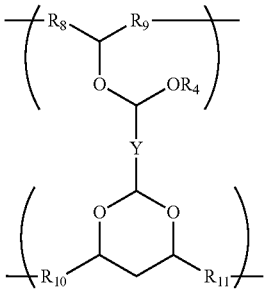

(XI)

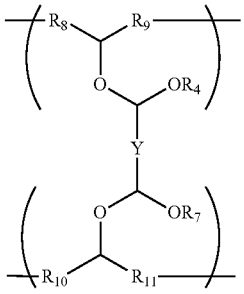

Y may form a multimer via $R'_3$ to $R'_8$ which is —O— or a substituted or unsubstituted $—(CH_2)_n—$.

The compound containing the structure of the formula (I) and the compound containing the structure of the formula (II) are each more preferably a compound containing at least one repeating unit selected from the group consisting of the following formulas (XII) to (XV).

(XII)

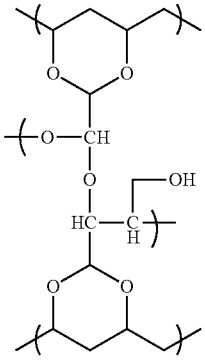

(XIII)

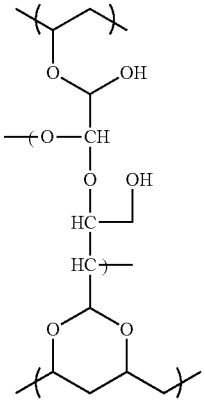

(XIV)

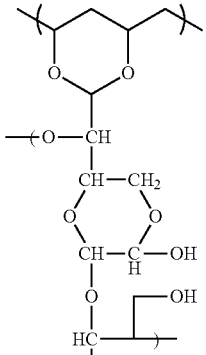

(XV)

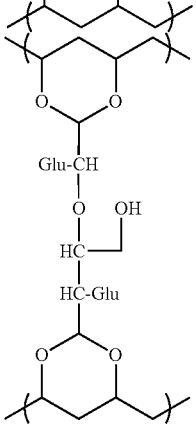

The compound of the formula (I) and the compound of the formula (II) may each be a polymer and the polymer has a weight average molecular weight of preferably 20000 or more, more preferably 100,000 or more, particularly preferably 300,000 or more. Further, the compound of the formula (I) and the compound of the formula (II) may each be a copolymer with another monomer. Examples of such another monomer include acrylic acid, acrylic acid esters, methacrylic acid, methacrylic acid esters, modified polyvinyl alcohols (acetoacetyl-modified, silanol-modified, cation-modified, carbonyl-modified, or ethylene-oxide-modified ones), allylamine and derivatives thereof, and diallylamine and derivatives thereof.

When the compound of the formula (I) and the compound of the formula (II) are each a polymer, examples of a synthesis process of them include a process of reacting a hydroxyl-containing polymer and a polyvalent aldehyde having, in the molecule thereof, at least one of ether and acetal. The polyvalent aldehyde acts as a crosslinking agent and the ether or acetal group of the polyvalent aldehyde reacts with the hydroxyl group of the polymer to form a crosslinked structure. In this case, a portion above Y in the structure of the formula (I) or (II) and a portion represented by the formula $R_1$ are derived from the polymer having, in the main chain thereof, a hydroxyl group reactive with the crosslinking agent, and Y is a portion derived from the polyvalent aldehyde as the crosslinking agent.

Specific examples of the hydroxyl-containing polymer include polyvinyl alcohols, starch derivatives such as oxidized starch, etherified starch, and phosphorylated starch, and cellulose derivatives. Examples of the cellulose derivatives include carboxymethyl cellulose and hydroxyethyl cellulose. Among them, polyvinyl alcohols are preferably used. Examples of the polyvinyl alcohols include typical polyvinyl alcohols obtained by the hydrolysis of polyvinyl acetate and derivatives thereof such as cation-modified polyvinyl alcohol, anionic polyvinyl alcohol having an anionic group, silyl-modified polyvinyl alcohol obtained by the substitution with a silyl group, and acetoacetyl-modified polyvinyl alcohol obtained by substitution with an acetoacetyl group. As the polyvinyl alcohol, typical unmodified polyvinyl alcohol is preferred. The polyvinyl alcohol has a saponification degree of preferably 70% or more and not more than 99%, more preferably 86% or more and not more than 96%. The polyvinyl alcohol has an average polymerization degree of 1000 or more, more preferably 2000 or more and not more than 4500.

Examples of the polyvalent aldehyde having, in the molecule thereof, at least one of ether and acetal include those prepared by conducting ring-opening of a diol portion (for example, a 2,3-diol portion of a glucose unit) of a saccharide such as starch or cellulose or a derivative thereof to form a polyvalent aldehyde. As an example of the process for forming a polyvalent aldehyde, oxidation with periodic acid is known. Although a saccharide to be oxidized with periodic acid is not particularly limited so long as it has a diol portion, using a monosaccharide or disaccharide is not preferred. Oxidation of a low molecular weight saccharide by the above-mentioned process may generate formic acid, formaldehyde, or the like as a byproduct because of difficulty in the control of the reaction. As the saccharide to be used in the reaction, oligosaccharides or polysaccharides having 5 or more sugar units (one unit per glucose unit) are preferred. The polyvalent aldehyde synthesized by the above process facilitates smooth reaction because it has a large number of hydroxyl groups and has high affinity with the hydroxyl-containing polymer. As a result, it can improve the advantageous effect of the present embodiment further. Specific examples of the polyvalent aldehyde include dialdehyde starch obtained by modifying starch or decomposition product thereof into a corresponding aldehyde by the above process. The dialdehyde starch to be used in the present embodiment has a molecular weight of preferably 1000 or more, more preferably 10000 or more. In the present embodiment, the introduction ratio of aldehyde groups is preferably 1.0/sugar unit or more, more preferably 1.5/sugar unit or more and not more than 1.9/sugar unit.

The compound of the formula (I) or (II) is preferably a reaction product of dialdehyde starch and polyvinyl alcohol. The compound of the formula (I) or (TI) can be prepared using the above raw materials, more specifically, by adding a dialdehyde starch solution to an aqueous solution of polyvinyl alcohol and heating the resulting mixture at 40° C. or more. It is preferred to perform the reaction by mixing the raw materials in an aqueous solution and drying the resulting mixture under heat because the reaction between polyvinyl alcohol and dialdehyde starch does not proceed smoothly in water. It is more preferred to provide a heating step after drying and then perform the reaction. Saccharides such as starch are likely to be colored by heating so that heating temperature is set at preferably 40° C. or more and not more than 80° C. As the reaction time, heating for 3 or more hours, more preferably 6 or more hours after drying is preferred.

As a method of confirming the presence of the compound of the formula (I) and/or the compound of the formula (II) in the ink receiving layer, the following method can be mentioned. First, the presence or absence of a polyvalent aldehyde, which is a decomposition product of the compound (I) and/or the compound (II), can be confirmed by analyzing an acid extract of the ink receiving layer of the recording medium by FT-IR (Fourier transform infrared spectrometer). Further, an acetal-derived peak at from 2,800 $cm^{-1}$ to 3,000 $cm^{-1}$, an aldehyde-derived peak in the vicinity of 1,730 $cm^{-1}$, or the like is analyzed by FT-IR ATR (attenuated total reflection) of the ink receiving layer of the recording medium. The state of the polyvalent aldehyde in the ink receiving layer can be confirmed by this analysis. By analyzing the acid extract by TOF-SIMS or GS-MS analysis, the structure of the portion Y of the formula (I) and/or the formula (II) can be analyzed. By these analysis methods, the presence or absence of the compound of the formula (I) and/or the compound of the formula (II) can be confirmed.

Binder

Examples of the binder include starch derivatives such as oxidized starch, etherified starch, and phosphorylated starch; cellulose derivatives such as carboxymethyl cellulose and hydroxyethyl cellulose: casein, gelatin, soybean protein, and polyvinyl alcohol, and derivatives thereof; conjugated polymer latexes such as polyvinyl pyrrolidone, maleic anhydride resin, styrene-butadiene copolymer, and methyl-methacrylate-butadiene copolymer; acrylic polymer latexes such as acrylic ester polymers and methacrylic ester polymers; vinyl-based polymer latexes such as ethylene-vinyl acetate copolymer; functional-group-modified polymer latexes obtained by modifying the above-mentioned binders with a functional-group-containing monomer such as carboxyl-containing monomer; the above-mentioned binders cationized with a cationic group and the above-mentioned binders having a surface cationized with a cationic surfactant; polymers obtained by polymerizing any of the above-mentioned binders in the presence of cationic polyvinyl alcohol to distribute the polyvinyl alcohol on the surface of the polymers; polymers obtained by polymerizing any of the above-mentioned binders in a suspended dispersion of cationic colloid particles to distribute cationic colloid particles on the surface of the polymers; aqueous binders of a thermosetting synthetic resin such as melamine resin or an urea resin; polymer and copolymer resins of a methacrylic acid ester or an acrylic acid ester, such as polymethyl methacrylate; and synthetic resin-based binders such as polyurethane resin, unsaturated polyester resin, vinyl chloride-vinyl acetate copolymer, polyvinyl butyral, and alkyd resin.

As the binder, synthetic resin binders can also be used and among them, thermoplastic resins are preferred. Preferred examples of the thermoplastic resins include acrylic resins, acrylic silicone-based resins, acrylic epoxy-based resins, acrylic styrene-based resins, urethane-based resins (for example, acrylic urethane-based resins and polyester-based urethane resins), styrene-butadiene-based resins, acrylonitrile-butadiene-based resins, and vinyl-acetate-based resins.

The above-mentioned binders may be used either singly or as a mixture of a plurality of them. Of these binders, polyvinyl alcohol and synthetic resin binders are preferred, with polyvinyl alcohol being more preferred. As described above, polyvinyl alcohol can be used as a raw material of the compound of the formula (I) or the compound of the formula (II). The above-mentioned compound can be formed by applying a coating liquid for the ink receiving layer containing the polyvinyl alcohol and the polyvalent aldehyde onto the base and reacting these raw materials during drying of the coating solution. In this case, unreacted polyvinyl alcohol can be left in the ink receiving layer after the above reaction by using the polyvinyl alcohol in an increased amount relative to that of the polyvalent aldehyde. This unreacted polyvinyl alcohol can be used as the binder for ink receiving layer. In this case, the amount of the unreacted polyvinyl alcohol is preferably 50 parts by mass or more and not more than 99 parts by mass, more preferably 70 parts by mass or more and not more than 95 parts by mass, each based on 100 parts by mass of the total amount of the polyvinyl alcohol added as the raw material. The total amount of the polyvinyl alcohol contained in the ink receiving layer is preferably 5 mass % or more and not more than 30 mass %, more preferably 7 mass % or more and not more than 25 mass %, each based on the total mass of the ink receiving layer.

Cationizing Agent

The ink receiving layer contains preferably a cationizing agent. As for the cationizing agent, a primary, secondary or tertiary amine is mentioned. More preferably, the ink receiving layer contains a cationizing agent which is a primary or secondary amine. The amine serving as the cationizing agent reacts with the polyvalent aldehyde, which is the raw material of the compound of the formula (I) or the compound of the formula (II), to form a cationized complex. By modifying the compound of the formula (I) or the compound of the formula (II) into a cationized complex, ink can be fixed efficiently to the ink receiving layer to improve the color developability and migration resistance of the ink. The content of the cationizing agent in the ink receiving layer is preferably 1 part by mass or more and not more than 25 parts by mass based on 100 parts by mass of the compound (I) and the compound (II). When the content of the cationizing agent falls within the above range, bronzing is prevented during image recording and deterioration in print quality can be suppressed. The cationizing agent is not limited so long as it contains, in the molecule thereof, an amino group and examples of it include primary or secondary amines, monomers of the salt thereof, polymers of the monomers, and copolymers between the above-mentioned monomer and another monomer. Examples of the cationizing agent include, but not limited to, alkylamines such as methylamine and ethylamine, amino alcohols such as ethanolamine, amino acid, polyvalent amines such as ethylenediamine, allylamine polymer, methyldiallylamine polymer, and copolymer containing any of them.

Inorganic Particles

The inorganic receiving layer contains inorganic particles. Examples of the inorganic particles include calcium carbonate, magnesium carbonate, calcium sulfate, barium sulfate, alumina, alumina hydrate, colloidal alumina, vapor phase process silica, wet process silica, colloidal silica, titanium dioxide, zinc oxide, zinc hydroxide, zinc sulfate, talc, clay, kaolin, and zeolite. Examples further include mixtures of two or more of these inorganic pigments.

Examples of the alumina include γ-alumina, α-alumina, δ-alumina, θ-alumina, and χ-alumina. Of these, γ-alumina synthesized by the vapor phase process is preferred from the standpoint of color developability and ink absorptivity. As the alumina hydrate, that represented by the following structural formula can be used preferably:

$$Al_2O_{3-n}(OH)_{2n}.mH_2O$$

(wherein, n represents any of 0, 1, 2, and 3 and m represents the number of 0 or more and not more than 10, preferably 0 or more and not more than 5, with the proviso that m and n do not represent 0 simultaneously). In many cases, $mH_2O$ represents an eliminable aqueous phase not involved in the formation of a crystal lattice so that m can represent either an integer or non-integer. The m may become 0 when the alumina hydrate is heated.

From the standpoint of the color developability of ink, the inorganic particles have preferably a primary particle size of 3 nm or more and not more than 50 nm. The primary particle size is not limited to it. Of the above-mentioned inorganic particles, the alumina hydrate or silica is preferred because it can form a porous structure excellent in ink absorptivity.

The content of the inorganic particles in the ink receiving layer is preferably 70 mass % or more and not more than 95 mass %, more preferably 75 mass % or more and not more than 93 mass %, based on the total mass of the ink receiving layer.

Boric Acid and Borate

The ink receiving layer can contain a boric acid or borate in such a range as not to impair the advantage of the present embodiment. When the coating liquid for ink receiving layer contains a boric acid or salt thereof, generation of cracks in the resulting ink receiving layer can be suppressed during drying of the coating liquid. Not only orthoboric acid ($H_3BO_3$) but also metaboric acid or hypoboric acid can be mentioned as examples of the boric acid which the ink receiving layer can contain. Examples of the borate include orthoborates, $InBO_3$, $ScBO_3$, $YBO_3$, $LaBO_3$, $Mg_3(BO_3)_2$, $Co_3(BO_3)_2$, hypoborates (for example, $Mg_2B_2O_5$ and $Co_2B_2O_5$), metaborates (for example, $LiBO_2$, $Ca(BO_2)_2$, $NaBO_2$, and $KBO_2$), tetraborates (for example, $Na_2B_4O_7.10H_2O$), and pentaborates (for example, $KB_5O_8.4H_2O$, $Ca_2B_6O_{11}.7H_2O$, and $CsB_5O_5$). Of these boric acids and the like, orthoboric acid is preferred from the standpoint of storage stability of the coating liquid for ink receiving layer and effect of suppressing generation of cracks. The content of the boric acid or salt thereof in the ink receiving layer is preferably 0.1 mass % or more and not more than 5 mass % based on the dry weight.

Other Additives

The ink receiving layer may contain, as another additive, a pH regulator, a thickening agent, a fluidity improver, an anti-foaming agent, a foam suppressor, surfactant, a release agent, a penetrant, a coloring pigment, and a coloring dye. As well as these additives, a fluorescence whitener, an ultraviolet absorber, an antioxidant, an antiseptic, a mildew proofing agent, a water resistance additive, a dye fixing agent, a curing agent, a weathering material, or the like may be added as needed, if necessary, to the ink receiving layer.

Process for Producing a Recording Medium

In the process for producing a recording medium in the present embodiment, an ink receiving layer can be formed by applying an ink receiving layer coating liquid onto a base and then drying the coating liquid. (1) The compound having the structure of the formula (I) and/or the compound having the structure of the formula (II) may be formed by adding raw materials of the compounds to a coating liquid for ink receiving layer, applying the resulting coating liquid onto a base, and reacting the raw materials with each other during drying the coating liquid. (2) The compound having the structure of the formula (I) and/or the compound having the structure of the formula (II) may be added in advance to the coating liquid before application. It is preferred to add the raw materials of the compounds in a coating liquid to cause the raw materials to react during drying of the coating liquid, thereby forming the above compounds. In this case, the ink receiving layer is formed, for example, by drying a coating liquid containing, as raw materials, a hydroxyl-containing polymer and a polyvalent aldehyde having, in the molecule thereof, at least one of ether and acetal. The application amount of the coating liquid for the ink receiving layer is preferably 20 g/m$^2$ or more and not more than 50 g/m$^2$, more preferably 30 g/m$^2$ or more and not more than 45 g/m$^2$, in terms of the mass after drying.

The coating liquid for the ink receiving layer can be applied using a known application method. For example, a slot die method, a slide bead method, a curtain method, an extrusion method, an air knife method, a roll coating method, or a rod bar coating method can be used. After application, the coating liquid can be dried by a hot air dryer, for example, a linear tunnel dryer, arch dryer, air loop dryer, or sine curve air float dryer. In addition, an infrared heating dryer or a dryer utilizing microwaves can also be used. A proper one can be selected from them as needed.

Image Recording Method

An image can be recorded on the recording medium of the present embodiment by adding ink thereto. The ink can contain at least one of a pigment and a dye as a coloring material. No particular limitation is imposed on the dye or pigment and a proper one is selected from those usable as a coloring material of ink. A necessary amount of it can be used. For example, as ink jet ink, known dyes, carbon black, and organic pigments can be used. A dye and/or a pigment dissolved and/or dispersed in a liquid medium can be used. Of these, various pigments are suited because they are characterized by durability and quality of printed products obtained.

A method of applying ink to the recording medium is not particularly limited, but ink jet recording method is preferred. This method is a method of ejecting ink from a recording head to be used in the ink jet recording method and recording an image on the recording medium. Examples of an ink jet method include a method of applying dynamic energy to ink and a method of applying heat energy to ink.

In the present embodiment, an ink jet recording method making use of heat energy is particularly preferred. The steps of the ink jet recording method are similar to known ones except that the recording medium of the present embodiment is used.

EXAMPLES

The present invention will hereinafter be described specifically by Examples. The present invention is not limited to the following examples. The term "part" or "parts" in Examples means part by mass or parts by mass, respectively.

Example 1

Dialdehyde Starch

Sodium periodate (18.7 g) was dissolved in 150 ml of deionized water, while 18.7 g of dextrin (product of Kishida Chemical) was dissolved in 100 ml of deionized water. The aqueous solution of sodium periodate was gradually added to the aqueous solution of dextrin while stirring. After addition of the whole aqueous periodate solution, the resulting mixture was stirred for 8 hours in a dark place. The reaction mixture was allowed to stand at 10° C. or less for 24 hours and the precipitate was removed from the reaction mixture by filtration. 8.0 g of calcium chloride is added to the filtrate, followed by stirring for one hour. The precipitate thus obtained was filtered off. 300 ml of acetone was added to 100 ml of the filtrate, followed by stirring for 30 minutes. The precipitate thus obtained was filtered off. The precipitate was rinsed sufficiently with acetone and ethanol. The resulting precipitate was analyzed by FT-IR and presence of a peak derived from an aldehyde group in the vicinity of 1730 cm$^{-1}$ revealed that it was dialdehyde starch.

Preparation of Base

A base was prepared under the following conditions. First, a paper stock having the following composition was prepared.

Pulp slurry (a 3 mass % slurry obtained by dispersing, in water, Laubholz Bleached Kraft Pulp (LBKP, freeness; 450 ml) of CSF (Canadian Standard Freeness) and Nadelholz Bleached Kraft Pulp (NBKP, freeness: 480 ml) of CSF at a ratio of 8:2 on mass basis): 100.00 parts Cationized starch: 0.60 part Heavy calcium carbonate: 10.00 parts Light calcium carbonate: 15.00 parts Alkyl ketene dimer: 0.10 part Cationic polyacrylamide: 0.03 part Next, the paper stock was subjected to paper making in a Fourdrinier machine. A three-stage wet press was performed, followed by drying in a multi-barrel dryer. The dried product was impregnated with an aqueous solution of oxidized starch such that the solid content application amount of the oxidized starch became 1.0 g/m$^2$ and dried further. After drying, the dried product was machine calendared into s base paper A having a basis weight of 170 g/m$^2$, a Stockigt sizing degree of 100 seconds, air permeability of 50 seconds, a Bekk smoothness of 30 seconds, and a Gurley stiffness of 11.0 mN.

Next, 25 g/m$^2$ of a resin composition composed of low density polyethylene (70 parts by mass), high density polyethylene (20 parts by mass), and titanium oxide (10 parts by mass) was applied onto one of the surfaces of the base paper A. Further, 25 g/m$^2$ of a resin composition composed of high density polyethylene (50 parts by mass) and low density polyethylene (50 parts by mass) was applied onto the other surface of the base paper A. Thus, a base 1 coated with the resin was prepared.

Formation of Ink Receiving Layer

Vapor phase process silica ("AEROSIL300", trade name; product of EVONIK) was added to deionized water to give its concentration of 22 mass %. Next, based on 100 parts by mass of the vapor phase process silica, 5.0 parts by mass of a cationic polymer ("Sharol DC902P", trade name; product of Daiichi Kogyo Seiyaku) was added. The resulting mixture was stirred to obtain a colloidal sol. The resulting colloidal sol was diluted with deionized water to give the vapor phase process silica concentration of 18 mass % to obtain a colloidal sol A. In addition, polyvinyl alcohol PVA235 (product of Kuraray, polymerization degree: 3500, saponification degree: 88%) was dissolved in deionized water to obtain an aqueous solution of polyvinyl alcohol having a solid content of 8.0 mass %.

The dialdehyde starch synthesized above was added to and dissolved in the aqueous solution of polyvinyl alcohol obtained above so that the solid content of the starch became 15 parts by mass based on 100 parts by mass of polyvinyl alcohol. With the resulting solution, a 3.0 mass % aqueous boric acid solution was mixed so that it became 10 parts by mass based on 100 parts by mass of the total solid content of the polyvinyl alcohol and the dialdehyde starch to obtain an aqueous polymer solution B. The colloidal sol A and the aqueous polymer solution B were mixed at a mass ratio (vapor phase process silica)/(polyvinyl alcohol) of 100:20 to obtain a colloidal sol C. The colloidal sol C thus obtained was applied onto the base 1 to give its dry layer thickness of 35 μm. The application of the coating liquid was performed at a liquid temperature of 40° C. by using a slide die. Next, the liquid applied onto the base was dried with warm air of 40° C. to prepare a recording medium 1. During drying, the polyvinyl alcohol and dialdehyde starch reacted with each other to form a compound represented by the following formula (XVI):

(XVI)

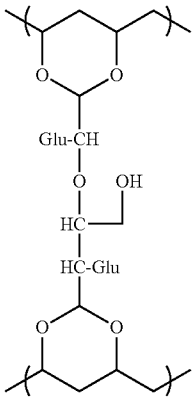

(Glu: glucose)

Example 2

In a manner similar to that of Example 1 except that a cationizing agent ("PAA-03", trade name; product of Nitto Boseki, allylamine polymer, primary amine) was added in an amount of 10 parts by mass based on 100 parts by mass of the total solid content of the polyvinyl alcohol and the dialdehyde starch, a recording medium 2 was prepared. In the present example, as in Example 1, the compound represented by the above formula (XVI) was formed during formation of the ink receiving layer.

Example 3

In a manner similar to that of Example 2 except that the content of a cationizing agent ("PAA-03", trade name; product of Nitto Boseki, allylamine polymer, primary amine) was changed to 1 part by mass based on 100 parts by mass of the total solid content of the polyvinyl alcohol and the dialdehyde starch, a recording medium 3 was prepared. In the present example, as in Example 1, the compound represented by the above formula (XVI) was formed during formation of the ink receiving layer.

Example 4

In a manner similar to that of Example 2 except that the content of a cationizing agent ("PAA-03", trade name; product of Nitto Boseki, allylamine polymer, primary amine) was changed to 25 parts by mass based on 100 parts by mass of the total solid content of the polyvinyl alcohol and the dialdehyde starch, a recording medium 4 was prepared. In the present example, as in Example 1, the compound represented by the above formula (XVI) was formed during formation of the ink receiving layer.

Example 5

In a manner similar to that of Example 2 except that the content of a cationizing agent ("PAA-03", trade name; product of Nitto Boseki, allylamine polymer, primary amine) was changed to 0.1 part by mass based on 100 parts by mass of the total solid content of the polyvinyl alcohol and the dialdehyde starch, a recording medium 5 was prepared. In the present example, as in Example 1, the compound represented by the above formula (XVI) was formed during formation of the ink receiving layer.

Example 6

In a manner similar to that of Example 2 except that the content of a cationizing agent ("PAA-03", trade name; product of Nitto Boseki, allylamine polymer, primary amine) was changed to 30 parts by mass based on 100 parts by mass of the total solid content of the polyvinyl alcohol and the dialdehyde starch, a recording medium 6 was prepared. In the present example, as in Example 1, the compound represented by the above formula (XVI) was formed during formation of the ink receiving layer.

Example 7

In a manner similar to that of Example 6 except that a cationizing agent ("PAS-M-1L", trade name; product of Nitto Boseki, methyldiallylamine hydrochloride polymer, tertiary amine) was used instead, a recording medium 7 was prepared. In the present example, as in Example 1, the compound represented by the above formula (XVI) was formed during formation of the ink receiving layer.

Comparative Example 1

In a manner similar to that of Example 1 except that the dialdehyde starch was replaced by glyoxal, a recording medium 8 was prepared. In the present comparative example, a compound represented by the following formula (XVII) was formed as a result of a reaction between the polyvinyl alcohol and glyoxal during formation of the ink receiving layer.

(XVII)

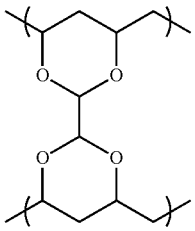

Comparative Example 2

In a manner similar to that of Example 1 except that the dialdehyde starch was replaced by glutaraldehyde, a recording medium 9 was prepared. In the present comparative example, a compound represented by the following formula (XVIII) was formed as a result of a reaction between the polyvinyl alcohol and glutaraldehyde during formation of the ink receiving layer.

(XVIII)

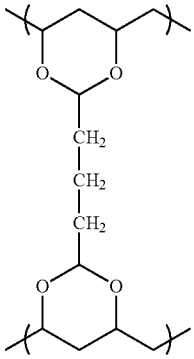

Comparative Example 3

In a manner similar to that of Example 1 except that the dialdehyde starch was replaced by formaldehyde, a recording medium 10 was prepared. In the present comparative example, a compound represented by the following formula (XIX) was formed as a result of a reaction between the polyvinyl alcohol and formaldehyde during formation of the ink receiving layer.

(XIX)

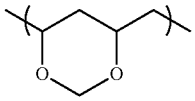

Comparative Example 4

In a manner similar to that of Example 1 except that the dialdehyde starch was replaced by zirconium acetate ("Zircozole ZA-20", trade name; product of Daiichi Kigenso Kagaku Kogyo), a recording medium 11 was prepared. In the present comparative example, a compound represented by the following formula (XX) was formed as a result of a reaction between the polyvinyl alcohol and zirconium acetate during formation of the ink receiving layer.

(XX)

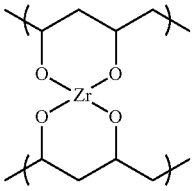

Comparative Example 5

In a manner similar to that of Example 1 except that the dialdehyde starch was not mixed, a recording medium 12 was prepared.

Comparative Example 6

In a manner similar to that of Example 2 except that the dialdehyde starch was not mixed, a recording medium 13 was prepared.

Comparative Example 7

In a manner similar to that of Comparative Example 6 except that boric acid was not mixed, a recording medium 14 was prepared.

Evaluation Method

In each of the following evaluation, '3' and '2' are preferable levels, and '1' is an unacceptable level. Incidentally, in the following evaluation, an image is recorded on a recording medium by using, as an ink jet recording apparatus, PIXUS MP990 (product of CANON) equipped with an ink cartridge BCI-321 (product of Canon). Recording using the above-mentioned ink jet recording apparatus is performed under the condition that an approximately 11 ng ink droplet is provided in a 1/600×1/600 inch unit region at a resolution of 600 dpi×600 dpi. The image thus recorded is defined as having a recording duty (Duty) of 100%.

Scratch Resistance

A black solid image having a recording duty of 200% is recorded on each of the recording media obtained above by using the above-mentioned ink jet recording apparatus at a temperature of 30° C. and humidity of 80%. Black solid printing is performed on the whole recording surface of Photo Paper "Pro Platinum" in no color correction mode at a temperature of 30° C. and humidity of 80%. The degree of scratches on the recording surface after printing is visually checked and evaluated based on the following evaluation criteria:

Evaluation Criteria

3: No scratches are found visually.

2: Scratches can be found when viewed at a certain angle.

1: Scratches can be found irrespective of the angle.

Bending Resistance

The recording medium of the A4 size is wound around the circumference of a cylindrical metal so that the ink receiving layer of the recording medium comes outside. In this case, whether the ink receiving layer is cracked or not is evaluated visually. The evaluation is made based on the following evaluation criteria.

Evaluation Criteria

3: No cracks occur in the ink receiving layer when it is wound around the circumference of the metal having a diameter of 20 mm.

2: Slight cracks occur in the ink receiving layer when it is wound around the circumference of the metal having a diameter of 20 mm.

1: An infinite number of large cracks occur in the ink receiving layer when it is wound around the circumference of the metal having a diameter of 20 mm.

Ink Absorptivity

A green solid image having a recording duty of 300% is recorded using the above-mentioned ink jet recording apparatus on each of the recording media obtained above at a temperature of 30° C. and humidity of 80%. Further, the print portion is observed visually and evaluated based on the following evaluation criteria.

Evaluation Criteria:

3: No unevenness is found in the solid portion.

2: Slight unevenness is found in the solid portion, but no problem is caused in practical use.

1: Unevenness is found in the solid portion and a problem is caused in practical use.

Migration

The following kanji character (1) of the 20-point size is printed in white on a blue solid having a recording duty of 30% by using each of the recording media thus obtained.

(1)

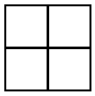

Then, after the resulting recording media are stored for one week at 30° C. and 90% R.H., the bleeding rate of the magenta at the white print portion is visually evaluated. Evaluation is performed based on the following evaluation criteria.

Evaluation Criteria:

3: No migration of magenta to the white portion occurs.

2: Slight migration of magenta to the white portion is observed and there is a change when compared visually with the print before storage but it causes no problem in practical use.

1: Migration of magenta to the white portion occurs and completely prevents recognition of the printed character, which causes a problem in practical use.

Bronzing

A blue solid image having a recording duty of 300% is recorded by using the above-mentioned ink jet recording apparatus on each of the recording media thus obtained at a temperature of 23° C. and a humidity of 50%. Further, the color of the solid image is visually observed at the time when light of a fluorescent lamp is applied thereto and is evaluated based on the following evaluation criteria.

Evaluation Criteria:

3: No change in color of the image caused by the applied light is observed between the print portion and non-print portion.

2: Slight change in color of the image caused by the applied light is observed between the print portion and non-print portion.

1: A change in color of the image caused by the applied light is observed between the print portion and non-print portion and colors seem different from each other.

The results obtained in Examples and Comparative Examples are shown below in Table 1.

TABLE 1

| | Scratch resistance | Ink absorptivity | Bending resistance | Migration | Bronzing |
|---|---|---|---|---|---|
| Ex. 1 | 3 | 3 | 3 | 2 | 3 |
| Ex. 2 | 3 | 3 | 3 | 3 | 3 |
| Ex. 3 | 3 | 3 | 3 | 3 | 3 |
| Ex. 4 | 3 | 3 | 3 | 3 | 3 |
| Ex. 5 | 3 | 3 | 3 | 2 | 3 |
| Ex. 6 | 3 | 3 | 3 | 3 | 2 |
| Ex. 7 | 3 | 3 | 3 | 2 | 3 |
| Comp. Ex. 1 | 3 | 3 | 1 | 2 | 3 |
| Comp. Ex. 2 | 2 | 3 | 1 | 2 | 3 |
| Comp. Ex. 3 | 3 | 2 | 1 | 2 | 3 |
| Comp. Ex. 4 | 3 | 3 | 1 | 2 | 3 |
| Comp. Ex. 5 | 1 | 1 | 2 | 2 | 3 |
| Comp. Ex. 6 | 1 | 1 | 2 | 2 | 3 |
| Comp. Ex. 7 | 1 | 1 | 3 | 2 | 3 |

While the present invention has been described with reference to exemplary embodiments, it is to be understood that the present invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-132352, filed Jun. 27, 2014, which is hereby incorporated by reference herein in its entirety.

What is claimed is:

1. A recording medium, comprising:

a base; and an ink receiving layer comprising inorganic particles having a primary particle size of 3 nm or more and not more than 50 nm, wherein a content of the inorganic particles in the ink receiving layer is 70 mass % or more and not more than 95 mass %, based on the total mass of the ink receiving layer, and at least one compound selected from a compound represented by the following formula (I) and a compound represented by the following formula (II), (I)

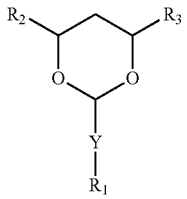

(II)

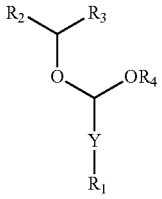

wherein, in the formulas (I) and (II), $R_1$ represents a structure represented by the following formula (III) or a structure represented by the following formula (IV), and $R_2$ to $R_4$ each independently represent a hydrogen atom or a structure represented by —$(CH_2)_n$—, where n represents an integer of 1 or more, and Y represents a structure represented by the following formula (V), (III)

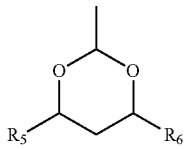

(IV)

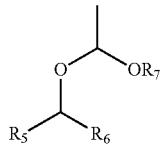

wherein, in the formulas (III) and (IV), $R_5$ to $R_7$ each independently represent a hydrogen atom or a structure represented by —$(CH_2)_n$—, where n represents an integer of 1 or more, (V)

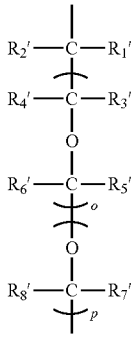

wherein, in the formula (V), o and p each independently represent an integer of 0 or more but o and p do not simultaneously represent 0, and $R'_1$ to $R'_8$ each independently represent a hydrogen atom, an alkyl group, a hydroxyalkyl group, a carbonyl group, —O—, a glucose group, or a structure represented by —$(CH_2)_n$— where n represents an integer of 1 or more, wherein the compound is obtained by causing dialdehyde starch, polyvinyl alcohol, and a primary or secondary amine to react with each other, and wherein the dialdehyde starch has a molecular weight of 10000 or more.

2. The recording medium according to claim 1, wherein the compound contains at least one repeating unit selected from the group consisting of the following formulas (VI) to (XI):

(VI)

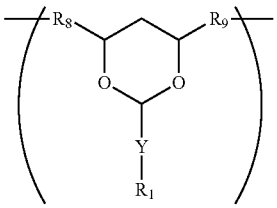

-continued (VII)

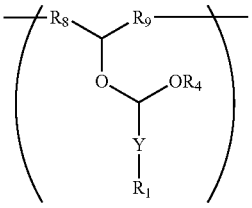

(VIII)

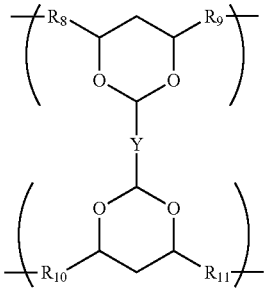

(IX)

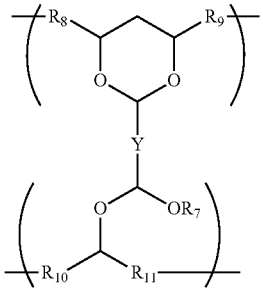

(X)

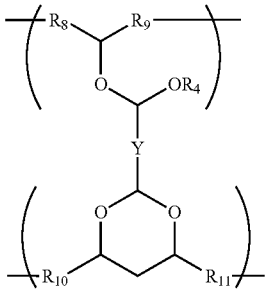

(XI)

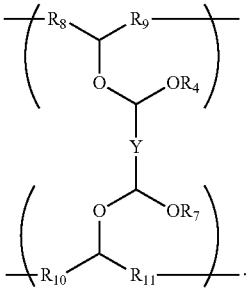

3. The recording medium according to claim 1, wherein the compound contains at least one repeating unit selected from the group consisting of the following formulas (XII) to (XV):

(XII)

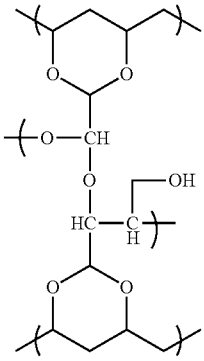

(XIII)

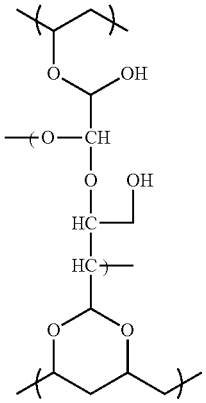

(XIV)

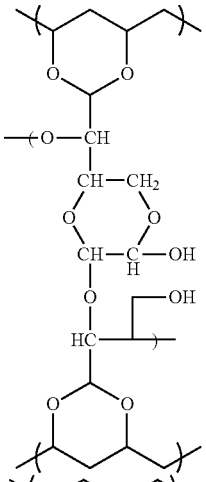

(XV)

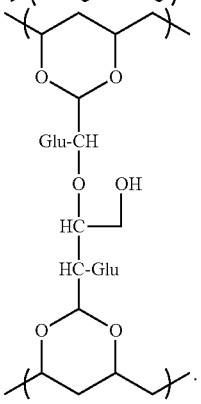

4. The recording medium according to claim 1, wherein the ink receiving layer is obtained by applying an ink receiver layer coating liquid comprising the inorganic particles, the dialdehyde starch, and the polyvinyl alcohol onto the base.

5. The recording medium according to claim 1, wherein the ink receiving layer is obtained by applying an ink receiver layer coating liquid comprising the inorganic particles, the dialdehyde starch, the polyvinyl alcohol, and the primary or secondary amine onto the base.

6. A process for producing a recording medium having a base and an ink receiving layer, the process comprising:

a step of applying an ink receiving layer coating liquid comprising inorganic particles, dialdehyde starch, and polyvinyl alcohol onto the base to form an ink receiving layer, wherein the ink receiving layer comprises the inorganic particles, which have a primary particle size of 3 nm or more and not more than 50 nm, wherein a content of the inorganic particles in the ink receiving layer is 70 mass % or more and not more than 95 mass % based on the total mass of the ink receiving layer and at least one compound selected from a compound represented by the following formula (I) and a compound represented by the following formula (II), (I)

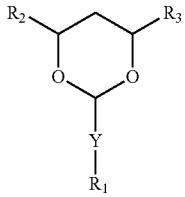

(II)

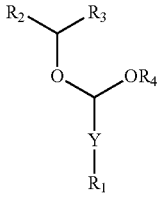

wherein, in the formulas (I) and (II), $R_1$ represents a structure represented by the following formula (III) or a structure represented by the following formula (IV), and $R_2$ to $R_4$ each independently represent a hydrogen atom or a structure represented by $—(CH_2)_n—$, where n represents an integer of 1 or more, and Y represents a structure represented by the following formula (V), (III)

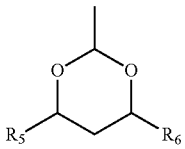

(IV)

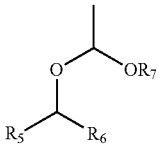

wherein in the formulas (III) and (IV) $R_5$ to $R_7$ each independently represent a hydrogen atom or a structure represented by —$(CH_2)_n$—where n represents an integer of 1 or more, (V)

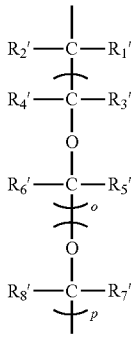

wherein, in the formula (V), o and p each independently represent an integer of 0 or more but o and p do not simultaneously represent 0 and $R'_1$ to $R'_8$ each independently represent a hydrogen atom, an alkyl group, a hydroxyalkyl group, a carbonyl group, —O—, a glucose group, or a structure represented by —$(CH_2)_n$— where n represents an integer of 1 or more, wherein the compound is obtained by causing the dialdehyde starch, the polyvinyl alcohol, and the primary or secondary amine to react with each other, and wherein the dialdehyde starch has a molecular weight of 10000 or more.

7. The recording medium according to claim 1, wherein the compound is obtained by causing the dialdehyde starch, the polyvinyl alcohol, and the secondary amine to react with each other.

* * * * *